US007628624B2

(12) United States Patent
Ye et al.

(10) Patent No.: US 7,628,624 B2
(45) Date of Patent: Dec. 8, 2009

(54) ELECTRICAL CARD CONNECTOR WITH AN IMPROVED GUIDING MEMBER

(75) Inventors: Ke-Hua Ye, Kunshan (CN); Qi-Jun Zhao, Kunshan (CN); Hua Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,095

(22) Filed: Dec. 8, 2008

(65) Prior Publication Data

US 2009/0149056 A1 Jun. 11, 2009

(30) Foreign Application Priority Data

Dec. 6, 2007 (CN) ..... 2007 2 0131267 U

(51) Int. Cl.
*H01R 13/44* (2006.01)

(52) U.S. Cl. ..... 439/137; 439/633; 439/946; 439/377

(58) Field of Classification Search ..... 439/135–140, 439/377, 630–635, 946
See application file for complete search history.

(56) References Cited

U.S. PATENT DOCUMENTS 6,764,323 B2 * 7/2004 Shimada et al. ..... 439/138
6,887,087 B2 * 5/2005 Lai et al. ..... 439/138
7,112,095 B2 * 9/2006 Shen et al. ..... 439/630
7,214,076 B1 5/2007 Sabo
7,309,259 B2 * 12/2007 Sun et al. ..... 439/630
7,377,814 B2 * 5/2008 Shen et al. ..... 439/630
7,455,555 B1 * 11/2008 Lai ..... 439/630
7,465,197 B1 * 12/2008 Wu et al. ..... 439/630
7,513,801 B2 * 4/2009 Cheng et al. ..... 439/638
2006/0014436 A1 * 1/2006 Wu ..... 439/630
2006/0110958 A1 * 5/2006 Shen et al. ..... 439/135
2006/0110959 A1 * 5/2006 Shen et al. ..... 439/136
2007/0082520 A1 * 4/2007 Takao ..... 439/159
2009/0149056 A1 * 6/2009 Ye et al. ..... 439/374

FOREIGN PATENT DOCUMENTS

CN 2857266 Y 1/2007
TW M268785 6/2005

* cited by examiner

*Primary Examiner*—James Harvey
(74) *Attorney, Agent, or Firm*—Wei Te Chung; Andrew C. Cheng; Ming Chieh Chang

(57) ABSTRACT

An electrical card connector (10) for receiving at least a first electrical card (100), includes an insulative housing (1) having a base portion (11), an arm portion (12) extending forwardly from the base portion, and a receiving space (14) formed between the base portion and the arm portion. A number of terminals (2) are mounted on the insulative housing and extend into the receiving space. A spring tab (3) has a retaining portion (31) fixed to the insulative housing and an engaging portion (32) extending from an end of the retaining portion. A guiding member (4) is cantileveredly fixed to the engaging portion to guide the first electrical card into the receiving space.

18 Claims, 10 Drawing Sheets

ELECTRICAL CARD CONNECTOR WITH AN IMPROVED GUIDING MEMBER

BACKGROUND OF THE INVENTION

1. Field of the Invention

The present invention generally relates to an electrical card connector and more particularly to an electrical card connector having a guiding member for guiding an electrical card into the electrical card connector.

2. Description of Related Art

A conventional electrical card connector is fixed in an electronic device such as a computer for receiving multiple electrical cards. Such connector usually includes an insulative housing, a plurality of terminals coupled to the insulative housing. The insulative housing has a base portion, a pair of arm portions extending from two lateral sides of the base portion, and a receiving space formed between the base portion and the arm portions for receiving the electrical cards. A pair of spring tabs are fixed to the insulative housing. A pair of guiding members each has a rear end pressing on the spring tab and a front end having a spindle pivoting at the arm portion of the insulative housing. Therefore, the guiding members could be fixed to the insulative housing.

However, the guiding members each has a complexity of structure which will increase the manufacturing costs and complicate the assembling processes.

Hence, an improvement over the prior art is required to overcome the problems thereof.

SUMMARY OF THE INVENTION

According to one aspect of the present invention, an electrical card connector for receiving at least a first electrical card, comprises an insulative housing having a base portion, an arm portion extending forwardly from the base portion, and a receiving space formed between the base portion and the arm portion. A plurality of terminals are mounted on the insulative housing and extend into the receiving space. A spring tab has a retaining portion fixed to the insulative housing and an engaging portion extending from an end of the retaining portion. A guiding member is cantileveredly fixed to the engaging portion to guide the first electrical card into the receiving space.

According to another aspect of the present invention, an electrical card connector adapted for insertion of multiple electrical cards, comprises an insulative housing having a receiving space for receiving the electrical cards. A plurality of terminals are coupled to the insulative housing and extend into the receiving space. A spring tab has a retaining portion fixed to the insulative housing and an engaging portion extending from one end of the retaining portion. A guiding member for guiding the first electrical card into the receiving space has a rear end fixed to the engaging portion and a front end essentially moving with the engaging portion along a height direction with respective to the retaining portion.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
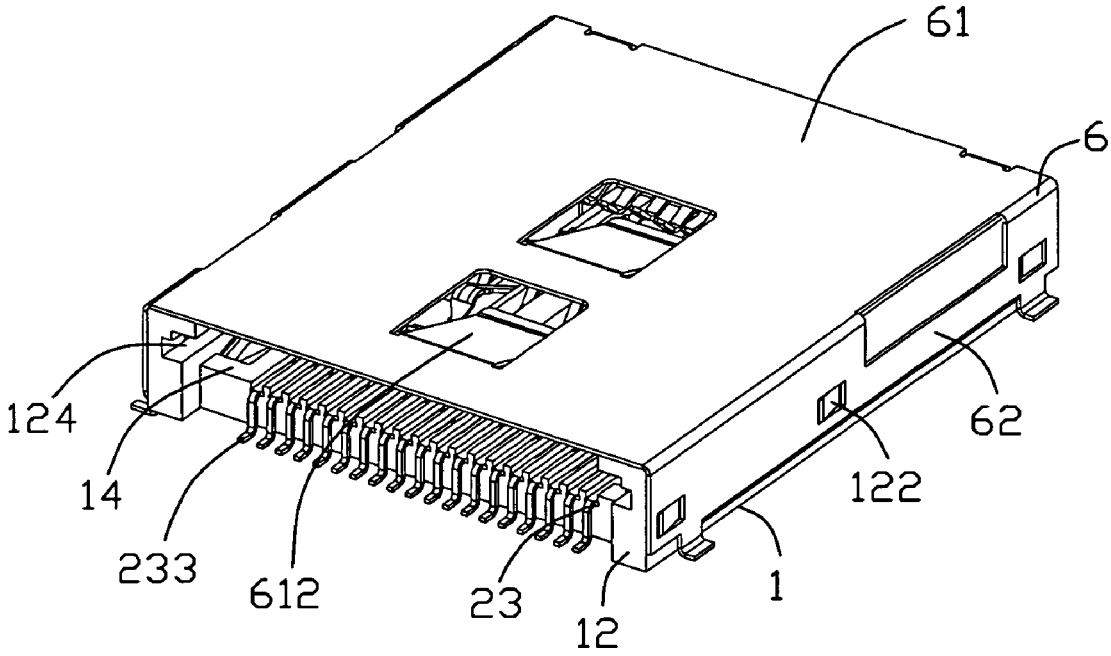
FIG. 1 is a perspective view of an electrical card connector according to the present invention.

Reference will now be made to the drawing figures to describe the preferred embodiment of the present invention in detail.

Figure 4:
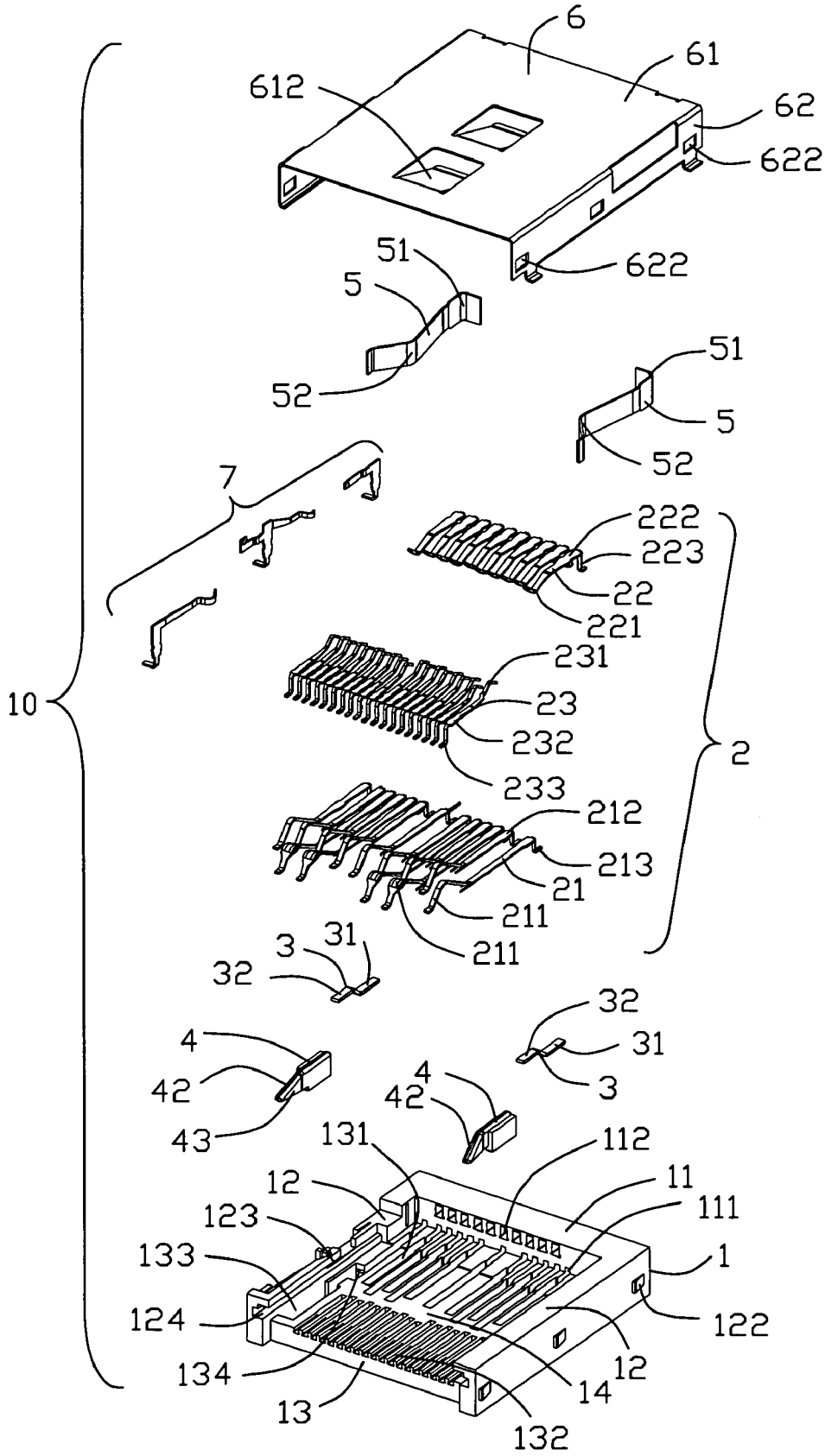
FIG. 4 is an exploded view of the electrical card connector shown in FIG. 1.

Referring to FIGS. 1 and 4, the electrical card connector 100 according to the present invention is adapted for insertion of multiple type of electrical cards. The electrical card connector 100 includes an insulative housing 1, a plurality of terminals 2 and detecting contacts 7 coupled to the insulative housing 1, a pair of spring tabs 3 and a pair of clips 5 fixed to the insulative housing 1, a pair of guiding members 4 fixed to the spring tabs 3, and a shell 6 enclosing the insulative housing 1.

Figure 2:
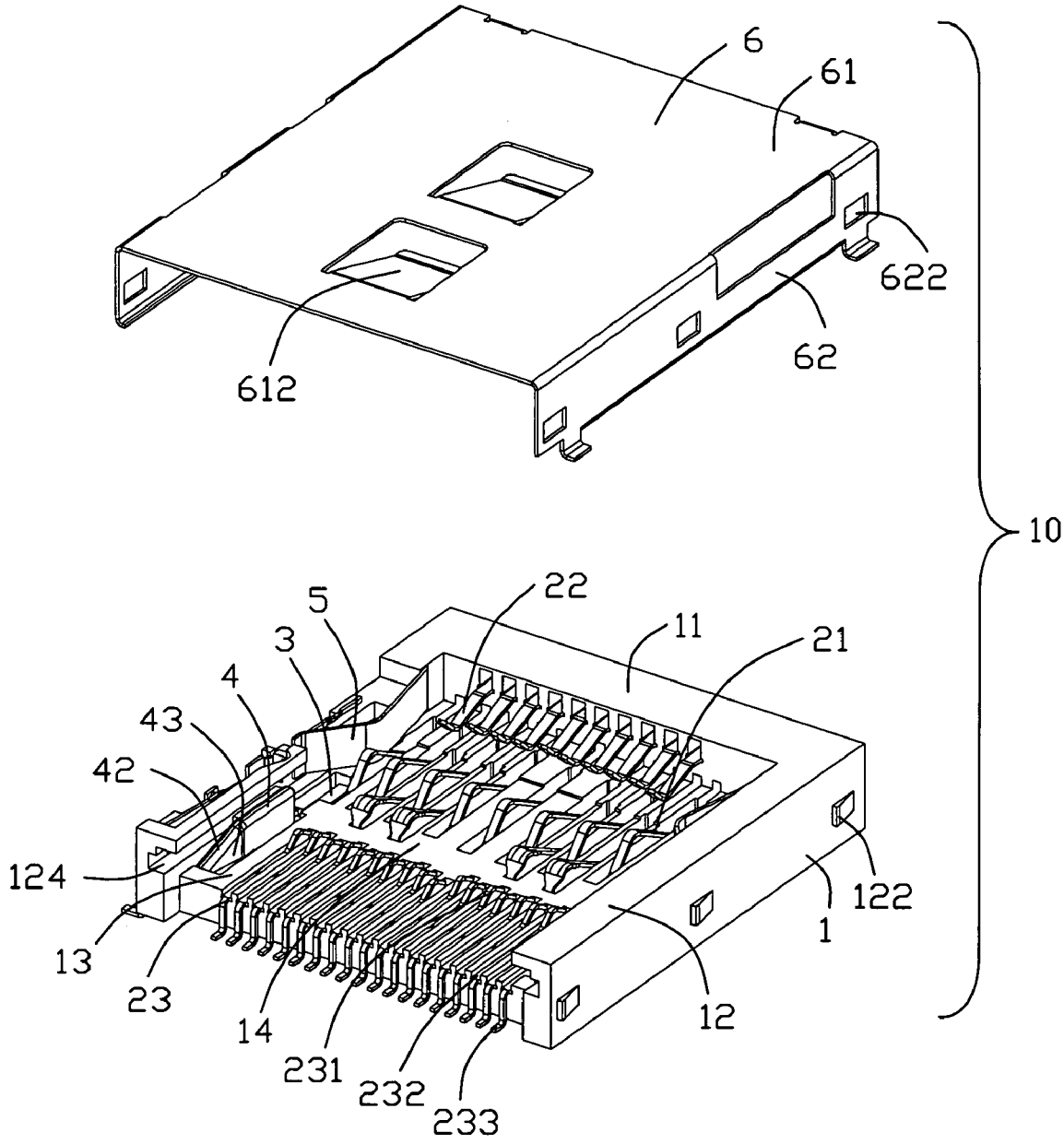
FIG. 2 is an partly exploded view of the electrical card connector shown in FIG. 1.
Figure 3:
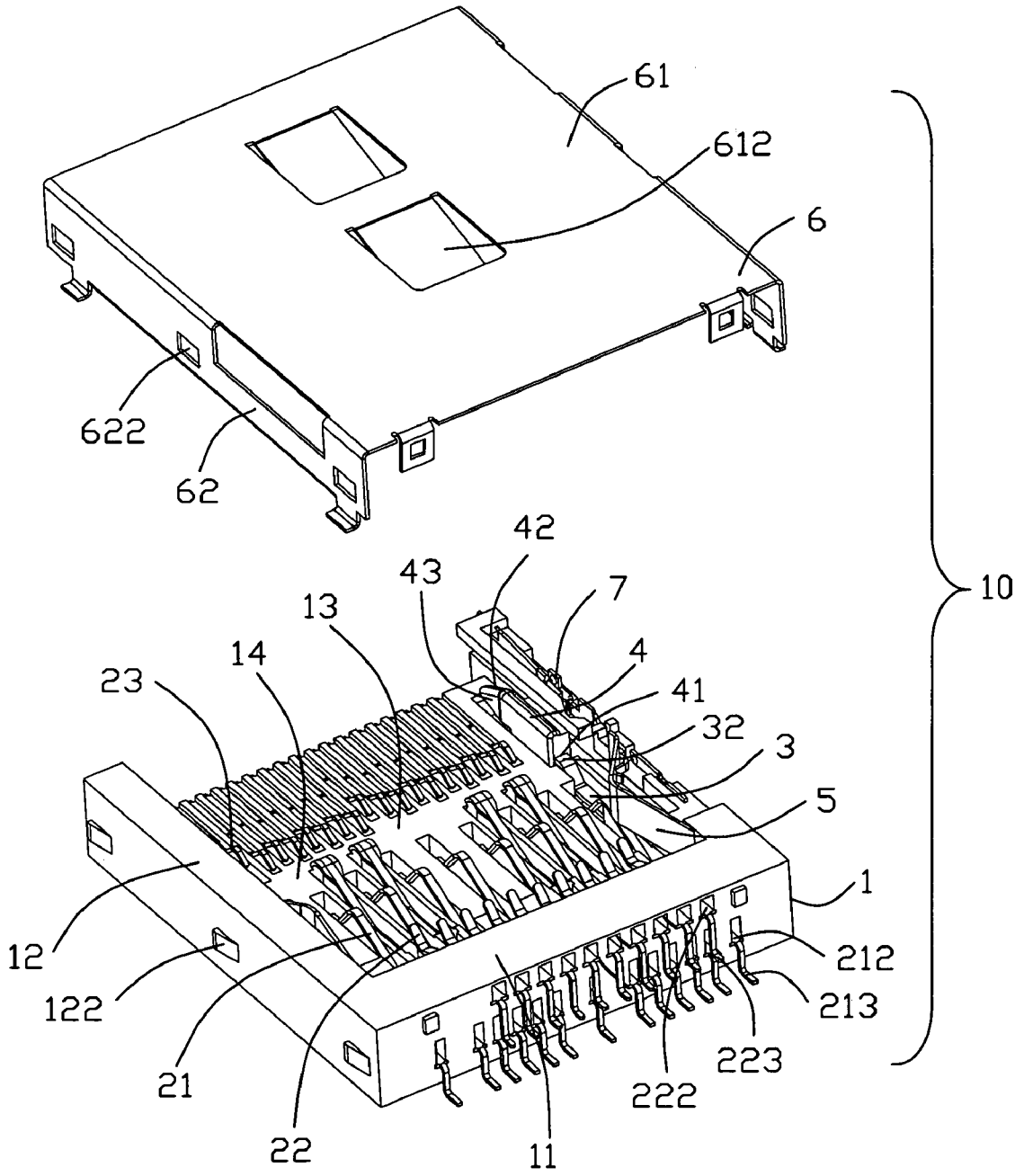
FIG. 3 is an another partly exploded view of the electrical card connector shown in FIG. 1.

Referring to FIGS. 2-4, the insulative housing 1 includes a base portion 11, a pair of arm portions 12 extending forwardly from two lateral sides of the base portion 11, a bottom wall 13 and a receiving space 14 formed between the base portion 11 and the arm portions 12. The base portion 11 has a plurality of first retaining slots 111 and a plurality of second retaining slots 112 located above the first retaining slots 111. The bottom wall 13 has a plurality of first passageways 131 formed on a rear end thereof and communicating with the first retaining slots 111, a plurality of third passageways 132 formed on a front end thereof, a pair of receiving chambers 133 formed on two lateral sides thereof and extending through the bottom wall 13, and a pair of grooves 134 formed on two lateral sides thereof and communicating with the receiving space 14. The receiving chamber 133 also communicates with the receiving space 14. Each arm portion 12 has a plurality of locking projections 122 formed on an outer side thereof and a plurality of reception openings 124 formed on an inner side thereof. One of the arm portion 12 has a plurality of fourth passageways 123 formed on upper side thereof for receiving the detecting contacts 7.

The terminals 2 include a plurality of first terminals 21, a plurality of second terminals 22 and a plurality of third terminals 23. Each first terminal 21 has a first contacting portion 211 received in the first passageway 131 and extending upwardly into the receiving space 14, a first securing portion 212 retained in the first retaining slot 111 and a first tail portion 213 extending backwardly from the first securing portion 212. Each second terminal 22 has a second contacting portion 221 extending downwardly into the receiving space 14, a second securing portion 222 retained in the second retaining slot 112 and a second tail portion 223 extending backwardly from the second securing portion 222. Each third terminal 23 has a third contacting portion 231 extending upwardly into the receiving space 14, a third securing portion 232 retained in the third passageway 132 and a third tail portion 233 extending forwardly from the third securing portion 232.

Each spring tab 3 has a retaining portion 31 extending horizontally and an engaging portion 32 bending upwardly from a front end of the retaining portion 31 and extending horizontally. The retaining portion 31 is retained in the groove 134.

Each guiding member 4 has a cavity 41 on a rear end to retain the engaging portion 32. A front end of the guiding member 4 can essentially move with the engaging portion 32 along a height direction with respect to the retaining portion 31. On the other word, the guiding member 4 is cantileveredly fixed to the engaging portion 32. Therefore, there is no need to fasten the guiding member 4 to the insulative housing 1, and the structure of the guiding member 4 is simple and miniature. The guiding member 4 has a first slanted surface 42 on an upper side thereof and a second slanted surface 43 on an inner side thereof. In accordance with a second embodiment of the present invention, the engaging portion 32 may be insert molded into the rear end of the guiding member 4.

Each clip 5 has a positioning portion 51 retained in the arm portion 12 and a clamping arm 52 extending into the receiving space 14 for abutting against two opposite side edges of the electrical cards.

The shell 6 has a main body 61 and a pair of side walls 62 extending downwardly from two lateral sides of the main body 61. The main body 61 has a pair of fingers 612 arranged in tandem and extending into the receiving space 14. Each side wall 62 has a plurality of perforations 622 for retaining the blocking projections 122 therein.

Figure 5:
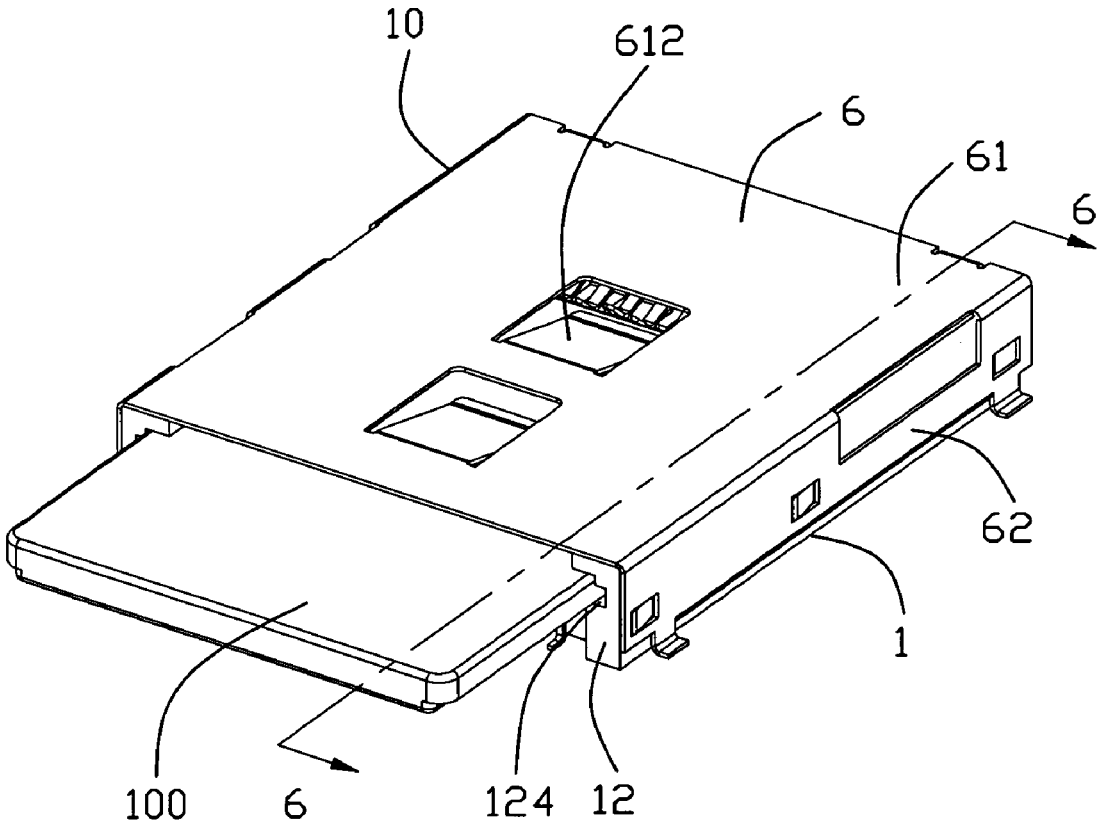
FIG. 5 is a perspective view of the electrical card connector with a first electrical card received therein shown in FIG. 1.
Figure 6:
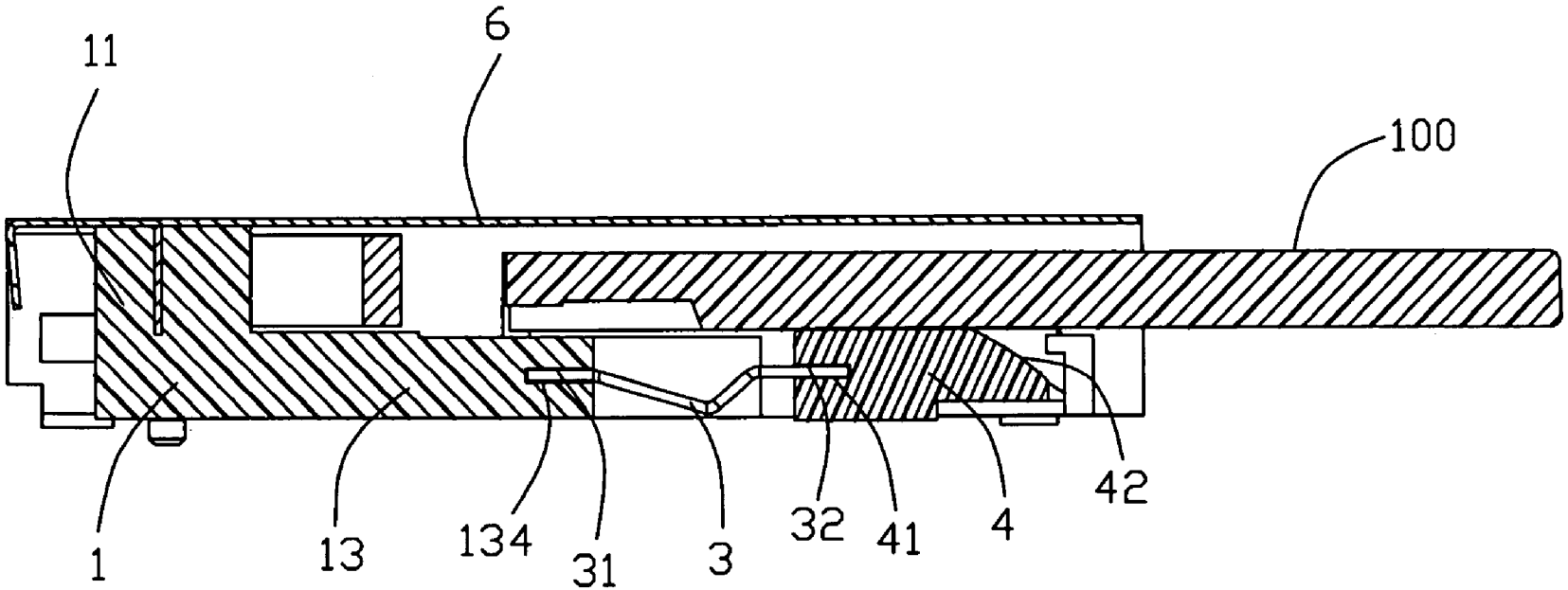
FIG. 6 is a cross-sectional view taken along line 6-6 shown in FIG. 5.
Figure 7:
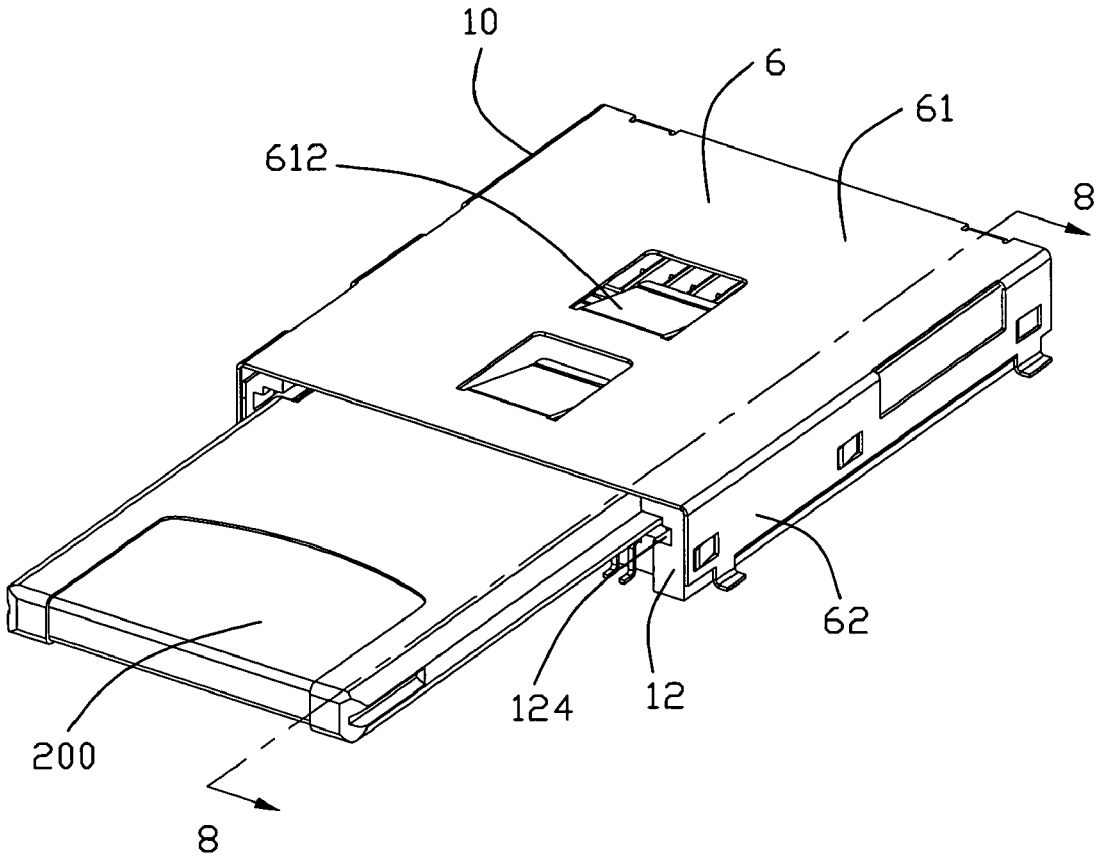
FIG. 7 is a perspective view of the electrical card connector with a second card received therein shown in FIG. 1.
Figure 8:
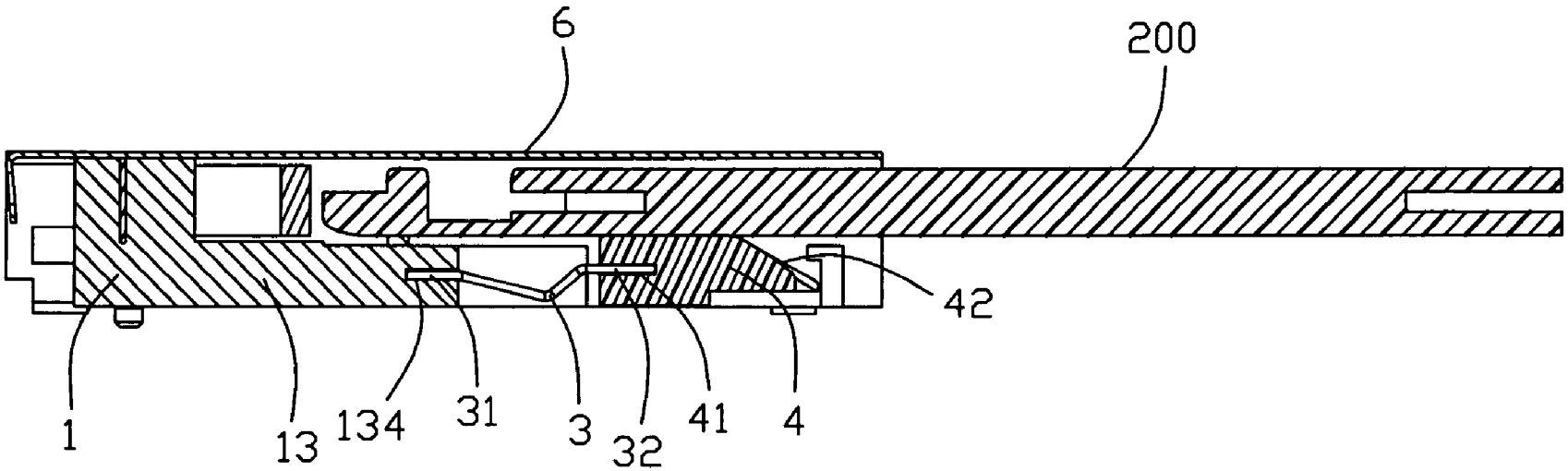
FIG. 8 is a cross-sectional view taken along line 8-8 shown in FIG. 7.
Figure 9:
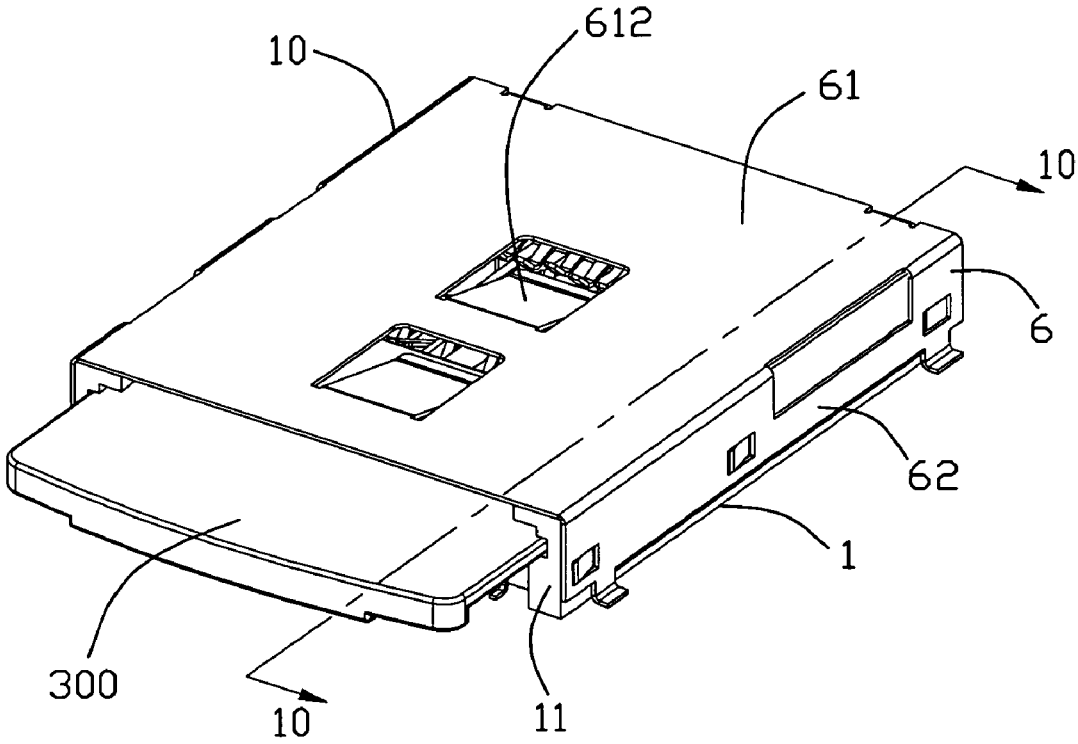
FIG. 9 is a perspective view of the electrical card connector with a third electrical card received therein shown in FIG. 1.
Figure 10:
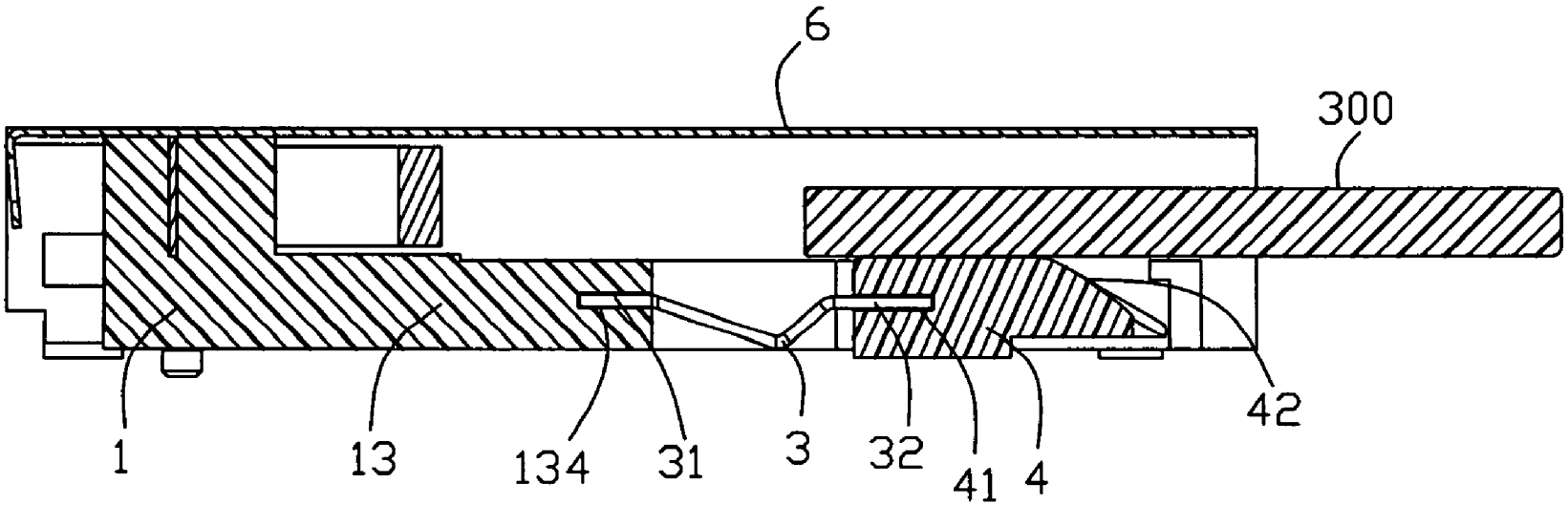
FIG. 10 is a cross-sectional view taken along line 10-10 shown in FIG. 9.

Referring to FIGS. 2-10, the electrical card connector 10 is adapted for insertion of a first electrical card 100, such as a SD card, a second electrical card 200 having a narrower width than that of the first electrical card 100, such as a MS card or MS Duo Card, and a third electrical card 300, such as a XD card. Referring to FIGS. 5 and 6, when the first electrical card 100 is inserted into the reception opening 124 of the insulative housing 1, the guiding members 4 move downwardly, meanwhile the first slanted surfaces 42 of the guiding members 4 guide the first electrical card 100 into the receiving space 14 so as to make an electrical connection with the first contacting portions 211. When the first electrical card 100 is inserted into the receiving space 14 completely, the first electrical card 100 is sandwiched between the fingers 612 and the guiding members 4 along a height direction of the insulative housing 1, at the same time, the clamping arms 52 of the clips 5 abut against two lateral sides of the first electrical card 100. Therefore, the first electrical card 100 could be retained in the insulative housing 1 stably. Referring to FIGS. 7 and 8, when the second electrical card 200 is inserted into the reception opening 124, the second slanted surfaces 43 of the guiding members 4 guide the second card 200 into the receiving space 14. When the second electrical card 200 is inserted into the receiving space 14 completely, the second electrical card 200 is sandwiched between the two guiding members 4 along a width direction of the insulative housing 1, at the same time, the fingers 612 abut against an upper surface of the second electrical card 200. Therefore, the second electrical card 200 could be retained in the insulative housing 1 stably. When the third electrical card 300 is inserted into the reception opening 124 of the insulative housing 1, the guiding members 4 are moved downwardly, meanwhile the first slanted surfaces 42 guide the third electrical card 300 into the receiving space 14 so as to make an electrical connection with the first contacting portions 231. When the third electrical card 300 is inserted into the receiving space 14 completely, the third electrical card 300 is sandwiched between the fingers 612 and the guiding members 4 along a height direction, therefore, the third electrical card 300 could be retained in the insulative housing 1 stably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector for receiving at least a first electrical card, comprising:

an insulative housing having a base portion, an arm portion extending forwardly from the base portion, and a receiving space formed between the base portion and the arm portion;

a plurality of terminals mounted on said insulative housing and extending into the receiving space;

a spring tab having a retaining portion fixed to the insulative housing and an engaging portion extending from an end of the retaining portion; and a guiding member cantileveredly fixed to the engaging portion to guide the first electrical card into the receiving space.

2. The electrical card connector as claimed in claim 1, wherein the insulative housing has a groove for retaining the retaining portion of the spring tab therein.

3. The electrical card connector as claimed in claim 1, wherein the guiding member has a cavity for retaining the engaging portion of the spring tab therein.

4. The electrical card connector as claimed in claim 1, wherein the engaging portion is insert molded into the guiding member.

5. The electrical card connector as claimed in claim 1, wherein the retaining portion extends horizontally, the engaging portion bends upwardly from the retaining portion and extends horizontally.

6. The electrical card connector as claimed in claim 1, wherein the guiding member has a first slanted surface on an upper side thereof for guiding the first electrical card into the receiving space.

7. The electrical card connector as claimed in claim 6, wherein the insulative housing has a bottom wall defining a receiving chamber extending through the bottom wall and communicating with the receiving space to receive the guiding member.

8. The electrical card connector as claimed in claim 7, wherein the terminals comprise a plurality of first terminals disposed on the bottom wall, each first terminal has a first contacting portion protruding into the receiving space for mating with the first electrical card.

9. The electrical card connector as claimed in claim 8, wherein the terminals comprise a plurality of second terminals disposed on the base portion and above the first terminals, each second terminal has a second contacting portion protruding into the receiving space for mating with a second electrical card whose width is narrower than that of the first electrical card.

10. The electrical card connector as claimed in claim 9, wherein the guiding member has a second slanted surface on an inner side thereof for guiding the second electrical card into the receiving space.

11. The electrical card connector as claimed in claim 8, wherein the terminals comprise a plurality of third terminals disposed on the bottom wall and before the first terminals for mating with a third electrical card.

12. The electrical card connector as claimed in claim 1, wherein the electrical card connector has a clip coupled to the arm portion to abut against the first electrical card.

13. The electrical card connector as claimed in claim 1, wherein the electrical card connector has a shell enclosing the insulative housing, the shell has a pair of fingers arranged in tandem and extending into the receiving space.

14. An electrical card connector adapted for insertion of multiple electrical cards, comprising:

an insulative housing having a receiving space for receiving the electrical cards;

a plurality of terminals coupled to said insulative housing and extending into the receiving space;

a spring tab having a retaining portion fixed to the insulative housing and an engaging portion extending from one end of the retaining portion and being deflectable along a height direction of the insulative housing; and a guiding member for guiding the first electrical card into the receiving space having a rear end fixed to the engaging portion and a front end movable with the engaging portion along the height direction.

15. The electrical card connector as claimed in claim 14, wherein the insulative housing has a bottom wall defining a groove at a lateral side thereof for retaining the retaining portion of the spring tab therein.

16. The electrical card connector as claimed in claim 15, wherein the bottom wall has a receiving chamber extending through the bottom wall and communicating with the groove.

17. The electrical card connector as claimed in claim 14, wherein the guiding member has a cavity at the rear end for retaining the engaging portion of the spring tab.

18. An electrical connector for use with cards with different thicknesses, comprising:

an insulative housing having a base with two side arms that form a card receiving cavity;

a plurality of contacts disposed in the base with contacting sections extending into the card receiving cavity;

a pair of insulative block type guiding members located in the card receiving cavity around the corresponding side arms, respectively;

each of said guiding members being discrete from the housing while connected to the housing via a metallic piece so as to be in a floating cantilevered manner for adjustably guiding the cards for insertion into the card receiving cavity;

wherein said base defines a pair of recesses to receive said pair of guiding members, respectively;

wherein said recesses extend through the base in the vertical direction for allowing the corresponding guiding members to be seated upon a printed circuit board on which the connector is mounted.

* * * * *